US005448880A

United States Patent [19]

Savinov et al.

[11] Patent Number: 5,448,880

[45] Date of Patent: Sep. 12, 1995

[54] SPINNING APPARATUS OF A CENTRIFUGAL SPINNING MACHINE

[75] Inventors: Evgeny R. Savinov; July R. Zeldin, both of Ivanovo, Russian Federation

[73] Assignee: Nauchno-Proizvodstvennoe Obschestvo s Ogranichennoi Otvetstvennostju "Test", Ivanovo, Russian Federation

[21] Appl. No.: 23,558

[22] PCT Filed: May 14, 1992

[86] PCT No.: PCT/RU92/00101

§ 371 Date: Feb. 26, 1993

§ 102(e) Date: Feb. 26, 1993

[87] PCT Pub. No.: WO93/00463

PCT Pub. Date: Jan. 7, 1993

[30] Foreign Application Priority Data

Jun. 26, 1991 [SU] U.S.S.R. ..... 4949085

[51] Int. Cl.[6] ..... D01H 1/08; D01H 7/74

[52] U.S. Cl. ..... 57/312; 57/76; 57/279; 57/313; 57/352

[58] Field of Search ..... 57/74, 75, 77, 312, 57/313, 352, 353, 354, 279

[56] References Cited

U.S. PATENT DOCUMENTS

| | | | |
|---|---|---|---|
| 1,489,199 | 4/1924 | Dreaper | 57/76 |
| 2,321,404 | 6/1943 | McCann | 57/76 |
| 2,574,455 | 11/1951 | Abbott | 57/312 |
| 3,111,804 | 11/1963 | Beyer | 57/76 |
| 3,167,901 | 2/1965 | Stetka | 57/313 |
| 3,343,358 | 9/1967 | Nussbaum | 57/34 |
| 4,040,240 | 8/1977 | Fujioka et al. | 57/312 |

FOREIGN PATENT DOCUMENTS

| | | | |
|---|---|---|---|
| 284489 | 11/1990 | Germany . | |
| 548460 | 4/1974 | Switzerland . | |
| 958189 | 5/1964 | United Kingdom | 57/354 |
| 1666587 | 7/1991 | U.S.S.R. | 57/312 |
| 1666587A1 | 7/1991 | U.S.S.R. . | |

OTHER PUBLICATIONS

M. I. Kulagin. Novyye sposoby prydadeniya sherstyanykh i khimicheskikh volokon (Russ.—New Methods for Spinning Wool and Man Made Fibres), Moscow, Legkaya Industriya (Publishers), 1974, pp. 28–33.

*Primary Examiner*—Daniel P. Stodola
*Assistant Examiner*—William Stryjewski
*Attorney, Agent, or Firm*—Merchant & Gould, Smith, Edell, Welter & Schmidt

[57] ABSTRACT

In the spinning unit of a centrifugal spinning machine the yarn conduct (4, 5) mounted between the revolving tube (2) and the yarn spreader (8) is designed so as to open on the side of the rewinding unit consisting of a winding drum (17) and a cartridge holder (18). The yarn conduct opens without displacement of the yarn (28) from its longitudinal axis. This allows to reduce the friction of the yarn (28) against the wall of the yarn conduct (4, 5) during the spinning process and to reduce the friction of the yarn (28) against the wall and the upper end of the spreader (8) during the rewinding process, as well as to bring the rewinding unit closer to the spinning unit.

5 Claims, 2 Drawing Sheets

SPINNING APPARATUS OF A CENTRIFUGAL SPINNING MACHINE

FIELD OF THE INVENTION

The invention relates to the textile industries or, more specifically, to centrifugal spinning machines, and can be used for the production of yarns from any type of fibre.

DESCRIPTION OF THE PRIOR ART

There is known a centrifugal spinning machine (M. I. Kulagin. Novyye sposoby pryadeniya sherstyanykh i khimicheskikh volokok (Russ.—New Methods for Spinning Wool and Man-Made Fibres), Moscow, Legkaya Industriya (Publishers), 1974, pp. 28–30), wherein each spinning unit contains a drawing mechanism, a yarn spreader, and a centrifuge. For spun yarn removal from the centrifuge, special bobbins (spools) are introduced thereinto, with immobile pirns (cores, tubes) placed over the bobbins. The yarn is thrown over the top end of an immobile pirn to be rewound over it by dint of the centrifuge's rotation, with bobbin and pirn withdrawn from the centrifuge thereafter.

One disadvantage of this machine is low output, due to a large number of manual operations associated with its use, such as spinning-in, moving bobbins in and out while rewinding, as well as operations associated with elimination of yarn breakage aftereffects.

Another disadvantage of this machine is that there is always a risk of yarn entanglement, while the yarn is rewound from the centrifuge rotating at a high speed, because of several/turns leading at a time from the centrifuge on to the pirn.

Another prior-art centrifugal spinning machine (M. I. Kulagin. Novyye sposoby pryadeniya sherstayanykh i khimicheskikh volokon (Russ.—New Methods for Spinning Wool and Man-Made Fibres), Moscow, Legkaya Industriya (Publishers), 1974, pp. 30–33) has a spinning unit comprising a pneumatic scroll tube mounted under the drawing mechanism and enabling automation of the spinning-in operation. However the second of the afore-mentioned disadvantages is likewise inherent in this other machine, inasmuch as yarn removal from the centrifuge likewise involves the use of immobile pirns to be introduced inside the centrifuges.

Also known in the art is a centrifugal spinning machine (SU, A, 1,666,587) consisting of several spinning units, each comprising the following elements arranged vertically down the yarn flow path: a drawing mechanism, a scroll tube, a yarn sensor, a cylindrical yarn conductor composed of two vertically spaced sections, with a clamping element in between, and a centrifuge complete with a yarn spreader installed so as to be capable of moving vertically inside the centrifuge bowl which has its open end facing upwards. The machine also contains yarn rewind devices to remove yarn from the centrifuges of the spinning units and means to thread yarn into the rewind devices, with the number of both rewind devices and yarn thread-in means being equal to that of the spinning units.

The yarn rewind assembly consists of a winding drum and a pirn holder mounted on a lever capable of rotating until the surface of the pirn placed in the pirn holder is in contact with that of the winding drum. The means to thread yarn into the rewind assembly has the form of two eye rings mounted one above the other between the clamping element and the lower section of the yarn conducting cylinder in line with the latter and roughly at the rewind assembly level. Each of the eye rings is linked with a lever of its own, and as this is turned the respective eye ring is removed from the yarn conductor zone toward the rewind assembly.

While spinning is in progress, the eye rings are in the position aligned with the yarn conducting cylinder, the yarn mowing vertically through the yarn conductor and eye rings from the automatic spinning-in device to the centrifuge. When the spun yarn is unloaded from the centrifuge, the clamping element holds the yarn while the eye ring levers are turned to displace the eye rings in a manner such that the yarn entrained therewith should be drawn in between the drum and pirn and wound over the latter.

Compared to the previously discussed counterpart, this machine affords automation of not only the yarn spinning-in operation, but also of spun yarn discharge.

A disadvantage inherent in the machine according to SU, A, 1,666,587 lies in the fact that as the yarn formed in the spinning process moves inside the closed yarn conducting cylinder sections it balloons while being rotated, contacting the conductor walls. This delays twist propagation along the yarn along its path between the centrifuge and the drawing mechanism, resulting in increased probability of yarn breakage—the yarn being low in strength—within the twist triangle, in the spinning process.

Besides, it is not all impossible for low-strength yarn breakage to occur also in the process of yarn being unloaded from the centrifuge to the rewind assembly. This is due to the fact that at the outlet from the spreader and while passing through the lower eye ring shifted off the yarn conductor axis the yarn being rewound from the centrifuge is bent at an angle close to the right angle. With such bends, there is increased friction of the yarn against the spreader wall and end face, and this may cause the insufficiently strong yarn to break.

Finally, the rewind assembly in each spinning place of the machine under discussion is located, of necessity, rather far from the respective spinning unit, thus leading to increased machine width. This is due to the requirement that, for achieving stable yarn spreading over the pirn, the distance between the surface of the winding drum and the upper end of the lower yarn conductor, whence the yarn is fed to the drum, should be 4 to 5 times greater than the spreading width.

DISCLOSURE OF THE INVENTION

The invention is based upon the objective of providing a centrifugal spinning machine, wherein the cylindrical yarn conductor in the spinning unit would be so designed as to reduce the probability of yarn breakages both in the spinning and rewinding processes and wherein it would be possible to place the rewind assembly closer to the spinning unit to thereby reduce the overall dimensions of the machine without impairing the stability of yarn spreading over the pirn.

The objective as stated above is achieved by providing that in a centrifugal spinning machine containing several spinning units in vertical arrangement, each comprising a drawing mechanism, a scroll tube, a cylindrical yarn conductor, and a centrifuge complete with a yarn spreader, as well as rewind assemblies to remove yarn from the centrifuges and means to thread yarn from the centrifuges into the rewind assemblies, the cylindrical yarn conductor is designed, in accordance with the invention, as an opening type, at least within the section from the yarn spreader down to the yarn thread-in means, so that the yarn passing over this section becomes exposed on the rewind assembly side while remaining aligned with the yarn conductor cylinder.

The opening section of the yarn conducting cylinder may be designed in the form of two cylinder halves installed so as to be capable of rotating about a vertical axle.

The capability of the yarn conductor to open up, without the path of the yarn passing therethrough being altered, will assure, firstly, lower friction between the ballooning yarn and the inner surface of the yarn conductor, providing thereby better conditions for twist propagation along the yarn over the path from the centrifuge to the drawing mechanism, and will enable, secondly, deflection of the yarn to the rewind assembly at a small angle to the yarn conductor axis, so that the yarn will bend but slightly at outlet from the spreader and will not be subject, accordingly, to heavy friction against the wall and end face of the latter. This will provide for lower yarn breakage probability both in the spinning process and while rewinding from the centrifuge. Besides, the opening-type of yarn conductor design makes it possible to accomodate the rewind assembly to the closest possible proximity to the spinning unit without any risk of disturbing effective yarn spreading over the pirn in the process of yarn unloading from the centrifuge, as will be shown below in the description of an embodiment of the invention. The result is reduced width of the spinning machine as a whole.

It is convenient for a suction air duct to be provided under the centrifuges having their bowls installed open ends down, fitted with holes, in which to install the open ends of the centrifuge bowls.

This will permit of removing from the centrifuges such foreign impurities as may evolve in the spinning and rewinding processes, as well as dust and wastes, and will improve the spinning-in conditions.

It is likewise convenient for each spinning unit to contain a means to supply steam into the centrifuge bowl.

Steam supplied to the centrifuges will favour relaxation of stresses such as may occur in the yarn when twisted and liable to cause snarl formations and sluff-offs in the rewinding process, these being potential causes for yarn breakages.

In the following, the invention will be made more fully apparent through a detailed description of an embodiment thereof, with due references to the accompanying drawings.

BEST MODE TO CARRY OUT THE INVENTION

Figure 1:
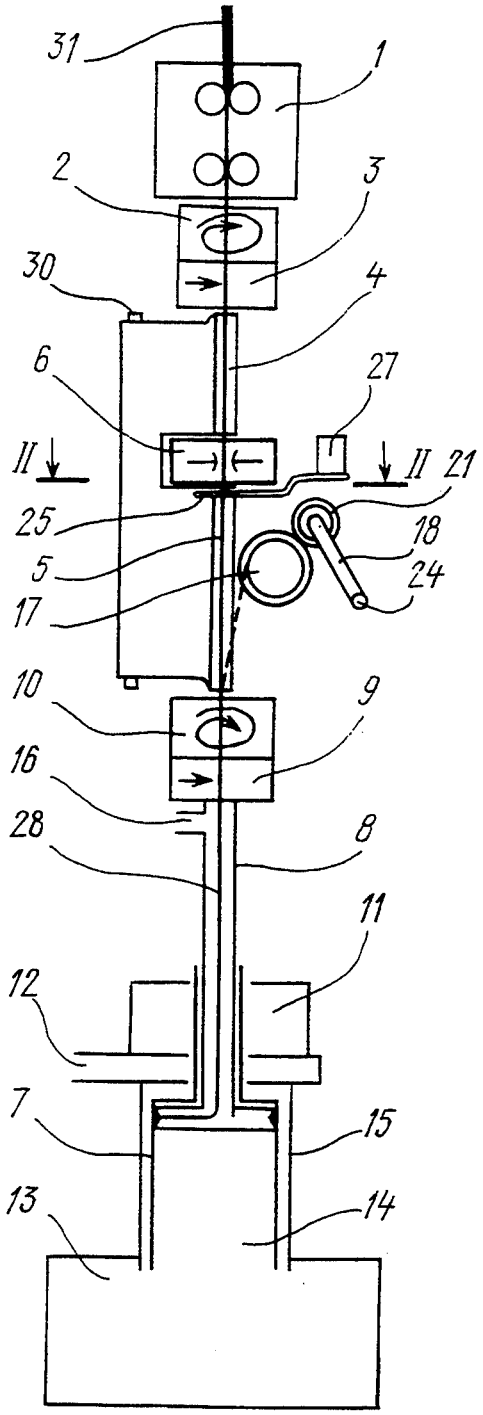
FIG. 1 is a schematic illustration of one spinning place in a centrifugal spinning machine according to the invention.

The centrifugal spinning machine consists of a plurality of spinning places, each comprising a spinning unit, a yarn rewind assembly to remove yarn from the centrifuge, and a means to thread yarn into the rewind assembly. One such spinning place is illustrated in FIG. 1. The spinning unit comprises, installed one under another, a drawing mechanism 1, a scroll tube 2, e.g. a pneumatic scroll tube, a yarn sensor 3, a cylindrical yarn conductor composed of sections 4 and 5, a clamping element 6 installed in between said sections, and a centrifuge 7 complete with a yarn spreader 8 in the form of a hollow cylinder mounted in the hollow axle of the centrifuge 7 and provided with a vertical displacement capability. Secured to the upper end of the spreader 8 are a second yarn sensor 9 and a second pneumatic scroll tube 10 designed to enhance spinning-in reliability. The drive 11 of the centrifuge 7 is attached to a spindle plate 12 which is part of the machine frame. The drives of the other mobile elements of the machine, specifically those of the clamping element 6, yarn spreader 8, and such others as are indicated hereinunder, are omitted from FIG. 1 to avoid complicating the drawing.

The clamping element 6 has the form of, e.g., two vertically arranged plates installed with a clearance to enable passage of yarn in between and capable of drawing together to clamp the yarn.

The sensors 3 and 9 may be of photoelectric or capacitive types, such as are widely used on automatic winding machines. The sensor 3 is designed to detect yarn breakages while spinning, the sensor 9 serves the same purpose while rewinding. The two sensors enable elimination of yarn breakage aftereffects, and their presence is not essential for the nature of the invention.

In the embodiment under discussion, the bowl of the centrifuge 7 has its open end facing downwards, and the spreader 8 enters the bowl through its bottom. Underneath the bowls of the centrifuge 7 of all the spinning units in the machine passes a suction air duct 13 with holes 14 fitted therein to take up the open bowl ends of the centrifuges 7. The bowl of each centrifuge 7 is enclosed in a cylindrical guard 15 to reduce the noise level and to seal the air duct 13 from the environment. The air duct 13 is designed to remove yarn remnants, dust, wastes, etc. from the bowls of the centrifuges 7, enhancing the reliability of spinner operation and enabling automation of the spinning-in and centrifuge bowl cleaning operations.

The spinning unit has a provision for steam to be supplied into the bowl of the centrifuge 7 for the purpose of relieving such stresses as may originate in the yarn while it is being formed in the spinning processes. This purpose is served by a nozzle 16 on the upper part of the spreader 8, communicating with a water vapour or steam-air mixture source (not shown).

The rewind assembly designed to remove yarn from the centrifuge comprised a winding drum 17 and a pirn holder 18, both attached to the machine frame (not shown). The pirn holder 18 is in the form of two levers 19 (FIGS. 2, 3, and 4) mounting rotary support disks 20 to mount the pirn 21 and a pressure disk 22 to hold the yarn to the end face of the adjacent support disk 20 when the yarn is lead on to the pirn 21. For drive, the pressure disk 22 uses, e.g., an electromagnet 23 secured to one of the levers 19. The levers 19 are mounted on a horizontal axle 24 so as to be capable of rotating until the pirn 21 makes contact with the drum 17, as shown in FIG. 1. Rewind units of this type are widely used in various kind of spinning and winding equipment.

The means used for threading in yarn into the rewind assembly is designed in this embodiment of the invention as a lever 25 fitted with a hook-shaped grip 26. The lever 25 is mounted on a vertical axle 27 in a manner such that its rotation causes the grip 26 to cross the longitudinal axis of the yarn conductor 4 and 5 (FIG. 1), along which axis passes the yarn 28 through the conductor. Other means may also be used to thread yarn into the rewind assembly, thus a nozzle blowing a jet of air on to the pirn 21, etc.

According to the invention, the yarn conductor 4 and 5 is designed in the form of two half-cylinders 29 (FIGS. 2, 3, and 4) mounted in an articulated manner on a vertical axle 30, with the parting plane of the yarn cylinder (the jointing plane of the cylinder halves 29) being normal to the axis of the winding drum 17. Owing to the split-type construction of the yarn conductor, the rewind assembly composed of the winding drum 17 and the pirn holder 18 is arranged in the immediate proximity to the axis of the cylindrical yarn conductor 4 and 5, hence to the spinning unit, yet, at the same time, at a sufficient distance, as may be seen from FIG. 1, from the upper end of the spreader, such as is necessary to assure effective yarn spreading over the pirn 21 when yarn is rewound from the centrifuge 7. It is obvious that the yarn conductor need not be made opening over its entire length, as shown in FIG. 1, only over the section 5 between the spreader 8 and the lever 25, but in this case twist propagation conditions during spinning would be somewhat impaired due to the yarn being in frictional contact with the inner surface of the upper yarn conductor section 4.

It is likewise obvious that the yarn conductor may be split in the horizontal plane rather than along the generating line of the cylinder, i.e. in the vertical plane, thus it may consist of two or more telescopically arranged cylinders. Of importance is the fact that, with the yarn conductor opening up, the yarn 28 passing therethrough becomes exposed on the side of the winding drum 17 and the pirn 21, without deviating from the vertical position.

Figure 2:
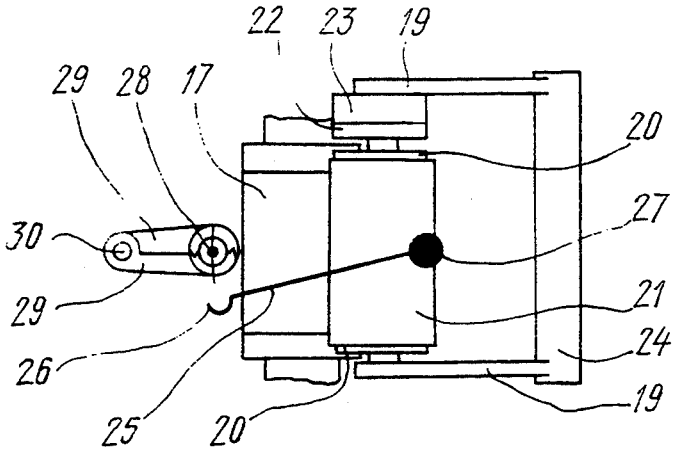
FIG. 2 is section II—II of FIG. 1 at the spinning-in stage.

The machine operates as follows. Prior to start up, the pirn holder 18 in each spinning place is drawn away from the drum 17, and a pirn 21 is installed in the pirn holder 18. This done, the pirn holder is set in the operating position, with the pirn 21 held pressed against the drum 17. Roving 31 is fed into the drawing mechanism 1. The drive 11 of the centrifuge 7 is started up and allowed to run up to operating speed. (It is convenient for the centrifuge drives of the spinning units to be started up in succession, shifted in time, so that removal of a spun-yarn package from any of the centrifuges would not necessitate stopping the others.). The operation of a spinning unit begins with the cylinder halves 29 being brought together to form a closed yarn conducting cylinder, as shown in FIG. 2, the plates of the clamping element 6 (FIG. 1) being set apart, and the spreader 8 set in the uppermost position. The roving 31 starts feeding into the drawing mechanism 1, forming a strand stretched roving at outlet therefrom. Air is supplied into the pneumatic scroll tubes 2 and 10, causing a rotating air stream oriented to flow in the downward direction through the yarn conductor 4 and 5.

Figure 3:
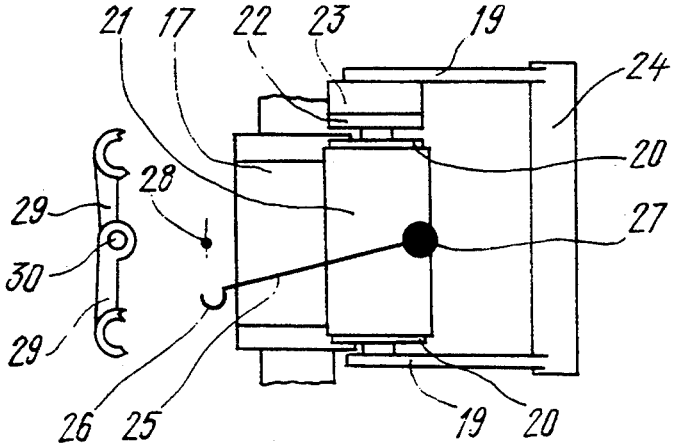
FIG. 3 is the same as FIG. 2 in the spinning process.
Figure 4:
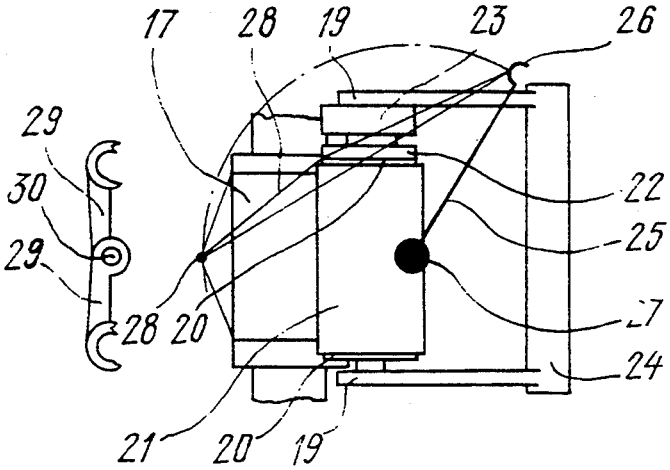
FIG. 4 is the same as FIG. 2 with yarn being threaded into the rewind assembly.

A fan (not shown) is started up to produce suction in the air duct 13, with the result that the air flow through the spreader 8 is additionally increased. Water vapour or humidified air is supplied when necessary into the nozzle 16 of the spreader 8. The rotating air stream entrains the strand to twist it and feed the yarn 28, formed, along the yarn conductor 4 and 5, through the spreader 8, and into the centrifuge 7. In the centrifuge 7, the yarn end is thrown against the bowl wall and held thereto centrifugally, following which the yarn gets twisted on account of its being rotated with the centrifuge 7. When the sensors 3 and 9 detect the presence of yarn in the yarn conductor 4 and 5, the air supply to the pneumatic scroll tubes 2 and 10 is discontinued, and the cylinder halves 29 of the yarn conductor rotate over the axle 30 to draw apart and occupy the position as shown in FIG. 3. Actually, the sections 4 and 5 of the yarn conductor cease to be cylindrical in form, and the yarn 28 is enabled in these sections to freely balloon without touching the walls of the cylinder halves 29, owing to which opportunity the twist imparted by the centrifuge 7 (FIG. 1) is more freely propagated along the yarn upwards, until the twist triangle is reached. In the meanwhile the spreader 8 is gradually displaced downwards, providing for yarn to be spread over the inner bowl wall of the centrifuge 7, based on a specified system.

When the spreader 8 reaches its lowermost position and the bowl of the centrifuge 7 is filled with a layer of yarn, the spun yarn is unloaded from the centrifuge 7, winding over the pirn 21. The procedure is as follows.

The plates of the clamping element 6 are brought together to hold the yarn 28 passing therebetween while the supply of roving 31 into the drawing mechanism 1 is discontinued. The lever 25 of the thread-in means is rotated to the position indicated in FIG. 4, its hook 26 gripping the yarn 28 and taking it away to the zone between the support disk 20 and the pressure disk 22. The electromagnet 23 is switched in at this point, its mobile core bearing upon the disk 22 to press it against the disk 20, clamping the yarn 28 between them. The winding drum 17 is started up to impart rotation to the pirn 21, the yarn 28 being entrained in between drum and pirn and wound over the latter while being supplied from the centrifuge 7 (FIG. 1) continuing in uninterrupted rotation. The yarn 28 breaks at the point where it is locked by the clamping element 6, its end being likewise wound upon the pirn. While rewinding is in progress, the spreader 8 travels upwards, thereby assuring constant rewinding conditions up till the rewinding process is complete.

Owing to the rewind assembly being located at a minimal distance from the yarn conductor 4 and 5, the yarn 28 is bent but slightly, as shown by dashed line in FIG. 1, when it leaves the spreader 8 and proceeds to the winding drum 17. The friction of the yarn against the wall and top end of the spreader 8 is therefore minimized, reducing the probability of yarn breakages due to rewinding.

In the spinning and rewinding processes, water vapour is supplied from the nozzle 16 to heat and humidify the yarn and, as a result, reduce the elastic stresses and degree of electrification therein, thereby improving yarn processing conditions at the subsequent process stages.

The sensor 9 serves to detect completion of the rewinding process. Then the spreader 8 returns to its initial position (at top), the cylinder halves 29 (FIG. 2) are brought together to form a closed yarn conducting cylinder, and the cycle is resumed.

Synchronization of the drives of the mobile elements comprised in the machine is by a control system (not shown) operating on a specified program.

In the event of yarn breakage, there are two alternatives for eliminating the after effects. Where the spinning unit comprises a clamping element 6 operable by a signal from the sensor 3, the yarn end formed as a result of breakage is clamped by the element 6, the lever 25 supplying yarn to the pirn 21 which serves to take up the yarn rewound from the centrifuge 7. In case the clamping element 6 is not available or fails to operate for some reason or other, the broken yarn end will be thrown into the bowl of the centrifuge 7. In such a situation, suffice it to stop the centrifuge 7 for several seconds. No centrifugal forces, gravity, and the air sucked in from top will clean the bowl of the centrifuge of what yarn, dust, and fluff may be present therein while the suction air duct 13 will serve to remove these to the wastes, after which the spinning process may be resumed in the manner essentially as described above.

INDUSTRIAL APPLICABILITY

The invention can be used for spinning operations in the textile industries. The invention can be utilized to best advantage for spinning low linear strength yarns.

We claim:

1. A centrifugal spinning machine for making a yarn from a fibrous product, having a plurality of spinning units in a vertical arrangement, each spinning unit comprising:

a drawing mechanism for forming a strand stretched roving from said fibrous product;

a scroll tube below said drawing mechanism for twisting said strand stretched roving coming from said drawing mechanism to a yarn in the beginning of a spinning cycle;

a vertically positioned cylindrical yarn conductor below said scroll tube for directing said yarn coming from said scroll tube;

a centrifuge below said yarn conductor for twisting said yarn coming from said yarn conductor during said spinning cycle, said centrifuge being provided with a yarn spreader for laying the yarn in said centrifuge; and said machine further comprising:

a rewind assembly positioned at one side of each of said yarn conductors for rewinding said yarn laid in said centrifuge, after the end of a spinning cycle; and a threading means for threading the yarn into said rewind assembly, said threading means being positioned at said one side of said yarn conductor so that at least a portion of said yarn conductor extends below said threading means, said yarn conductor including at least two parts at least one of which is movable with respect to the other to a position at which said yarn conductor opens exposing the yarn to said threading means at least along said yarn conductor portion extending below said threading means.

2. A centrifugal spinning machine according to claim 1, wherein said yarn conductor includes two halves each pivotably mounted to rotate about a vertical axle in a direction opposite to the direction of rotation of the other half.

3. A centrifugal spinning machine according to claim 1, wherein each of said spinning units comprises a suction air duct having a hole, said centrifuge being provided with a bowl having an open end and positioned with said open end down in said hole of the suction air duct.

4. A centrifugal spinning machine according to claim 3, wherein each of said spinning units comprises means for supplying steam into said yarn spreader.

5. A centrifugal spinning machine for making a yarn from a fibrous product, having a plurality of spinning units in a vertical arrangement, each spinning unit comprising:

a drawing mechanism for forming a strand stretched roving from said fibrous product;

a scroll tube below said drawing mechanism for twisting said strand stretched roving coming from said drawing mechanism to a yarn in the beginning of a spinning cycle;

a vertically positioned cylindrical yarn conductor below said scroll tube for directing said yarn coming from said scroll tube;

a centrifuge below said yarn conductor for twisting said yarn coming from said yarn conductor during said spinning cycle, said centrifuge being provided with a yarn spreader for laying the yarn in said centrifuge;

said machine further comprising:

a rewind assembly positioned at one side of each of said yarn conductors for rewinding said yarn laid in said centrifuge, after the end of a spinning cycle;

a threading means for threading the yarn into said rewind assembly, said threading means being positioned at said one side of said yarn conductor so that at least a portion of said yarn conductor extends below said threading means, said yarn conductor including at least two parts at least one of which is movable with respect to the other to a position at which said yarn conductor opens exposing the yarn to said threading means at least along said yarn conductor portion extending below said threading means; and wherein each of said yarn conductor includes two halves each pivotably mounted to rotate about a vertical axle in a direction opposite to the direction of rotation of the other half.

* * * * *